US005232499A

United States Patent [19]

Kato et al.

[11] Patent Number: 5,232,499

[45] Date of Patent: Aug. 3, 1993

[54] FLUID METERING AND COATING DEVICE

[75] Inventors: Hiroshi Kato; Hiroyasu Kikukawa, both of Okayama, Japan

[73] Assignee: W. L. Gore & Associates, Inc., Newark, Del.

[21] Appl. No.: 768,052

[22] Filed: Sep. 30, 1991

[30] Foreign Application Priority Data

Oct. 1, 1990 [JP] Japan ..... 2-260513

[51] Int. Cl.[5] ..... B05L 1/10; G03G 15/20

[52] U.S. Cl. ..... 118/244; 118/249; 118/258; 118/260; 118/264; 118/270; 118/DIG. 15; 355/284

[58] Field of Search ..... 118/249, 258, 260, 270, 118/DIG. 15, 244, 264; 355/284

[56] References Cited

U.S. PATENT DOCUMENTS

| | | | |
|---|---|---|---|
| 4,530,140 | 7/1985 | Okamura et al. | 29/110 |
| 4,796,046 | 1/1989 | Suzuki et al. | 355/284 |
| 5,068,692 | 11/1991 | Menjo | 355/284 |

FOREIGN PATENT DOCUMENTS

| | | | |
|---|---|---|---|
| 58-20033 | 4/1983 | Japan | 355/284 |
| 59-168479 | 9/1984 | Japan | 355/284 |
| 61-148479 | 7/1986 | Japan | 355/284 |
| 61-151676 | 7/1986 | Japan | 355/284 |
| 61-183679 | 8/1986 | Japan | 355/284 |
| 61-243836 | 10/1986 | Japan | 355/284 |
| 61-245178 | 10/1986 | Japan | 355/284 |
| 63-172186 | 7/1988 | Japan | 355/284 |
| 1-205188 | 8/1989 | Japan | 355/284 |
| 2-308289 | 12/1990 | Japan | 355/284 |

OTHER PUBLICATIONS

"Nonadhesive Elastic Body Roller for Fixation" JP1,031,180, 1 Feb. 1989 Minolta Camera, Abstract.

"Supplying Device for Offset Preventive Oil of Electronic Copying Machine" Abstract of 61-14879 (Nitto Kogyo K.K.) 7 Jul. 1986.

"Oil Applying Mechanism for Copying Machine" JP62 178 992 (Japan Gore-Tex Inc.) 6 Aug. 1987, Abstract.

"Fixing Device for Copying Machine or the Like" JP 61 240 266 (Sumitomo Electric Ind. Ltd.) 25 Oct. 1986, Abstract.

*Primary Examiner*—W. Gary Jones
*Assistant Examiner*—Todd J. Burns
*Attorney, Agent, or Firm*—Gary A. Samuels

[57] ABSTRACT

A liquid metering and coating device made of a liquid permeation control layer adhered to a porous support in which the support is an open-celled foam internally reinforced to obtain the strength, resilience, and heat resistance needed for high durability in use as a part of a hot toner image fixation mechanism in a plain paper copying machine.

4 Claims, 1 Drawing Sheet

FLUID METERING AND COATING DEVICE

FIELD OF THE INVENTION

The present invention relates generally to materials and devices for coating controlled amounts of liquids on to rolls or other surfaces.

BACKGROUND OF THE INVENTION

In a plain-paper (PPC) copying machine toner images applied to the surface of paper or other recording medium are fixated by application of heat and pressure. In certain PPC copying machines fixation is accomplished by passing the image-bearing recording medium between a hot thermal-fixation roll and a pressure roll. When this type of thermal-fixation device is used the toner material is directly contacted by a roll surface and a portion of the toner adheres to the roll surface. With subsequent rotation of the roll the adhered toner material may be redeposited on the recording medium resulting in undesirable offset images, stains, or smears; or, in severe cases, the recording medium may stick to the adhered toner material on the roll and become wrapped around the roll.

To counter these problems materials having good release properties such as silicone rubber or polytetrafluoroethylene are often used for the roll surfaces. Although improving performance of the thermal fixation devices, use of silicone rubber or polytetrafluoroethylene roll surfaces alone do not eliminate the problems. Another approach used to counter the problems is to include release agents with the toner materials to prevent them from adhering to the roll surface. These oilless toners also improve performance of the thermal-fixation devices but again, particularly in the case of high-speed type copying machines, do not completely eliminate the problems associated with toner pickup and transfer.

Toner pickup by the rolls can be controlled by coating the surface of at least one of the rolls of a thermal fixation device with a liquid release agent, such as a silicone oil. It is important that the release liquid be applied uniformly and in precise quantities to the surface of the roll. Too little liquid, or non-uniform surface coverage, will not prevent the toner from being picked up and redeposited on the roll. On the other hand, excessive quantities of the release liquid may cause silicone rubber roll surfaces to swell and wrinkle, thus producing copies of unacceptable quality. Furthermore, procedures intended to accommodate excess liquids by wiping or scraping them from the roll surface do not always produce favorable results and, in some cases, the efforts result in static electricity that cause further problems.

Devices to uniformly meter and coat a release liquid on copy machine roll surfaces are described in Japanese Laid-Open Patent No. 62-178992. These devices consist of an oil permeation control layer adhered to a thick porous material which serves as a wick or reservoir for supplying oil to the permeation control layer. The permeation control layer is typically a porous polytetrafluoroethylene film which has been impregnated with a mixture of silicone oil and silicone rubber followed by a heat treatment to crosslink the silicone rubber. The thick porous material to which the permeation control layer is adhered is typically porous polytetrafluoroethylene tubing or felts of Nomex (TM) fibers, glass fibers, carbon fibers, or polytetrafluoro-ethylene fibers.

The devices described in Japanese Laid-Open Patent No. 62-178992 meter and uniformly coat roll surfaces with release liquids at rates of 0.3 to 1.0 microliters/A4 size paper copy. They have been used successfully in copying machines and provide satisfactory performance until approximately 80,000 to 180,000 copies have been made. At this time, usually due to deformation and failure of the thick porous material supporting the permeation control layer or to separation of the permeation control layer from the thick porous layer, they can no longer perform acceptably and must be replaced.

This level of performance and durability is not satisfactory for many high-speed automated PPC copying machines for which release liquid metering and coating devices capable of delivering much smaller liquid quantities for much higher numbers of copies are needed.

SUMMARY OF THE INVENTION

This invention provides a liquid metering and surface coating device which can satisfactorily perform the operation of applying a release liquid, for example, to the surface of toner image fixation rolls in PPC copying, with exceptional accuracy, uniformity, and durability.

The device comprises a liquid permeation control layer adhered to a porous support; said support comprising an open-celled thermosetting polymer foam internally reinforced to obtain the strength, resilience, and heat resistance needed for high durability in use as part of a hot toner image fixation mechanism in a PPC copying machine; said porous internally reinforced support comprising materials having high compatibility with and wettability by the liquids to be distributed and having high liquid holding capacity so as to provide smooth continuous liquid replenishment to the permeation control layer.

DETAILED DESCRIPTION OF THE INVENTION

Figure 1:
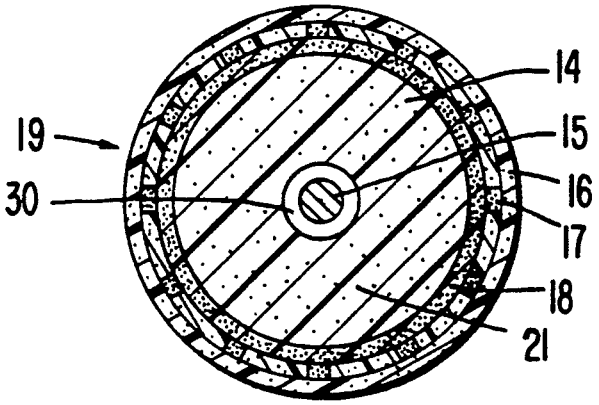
FIG. 1 shows a cross-section of an embodiment of the invention.

FIG. 1 shows a preferred embodiment of the invention formed by first axially mounting a tubular porous support material 14 on a metal shaft 15. The porous support material should be an open-cell foam or other continuous pore structure having a pore volume of at least 40%, preferably in the range 80 to 99.9%. Materials with pore volume less than 40% have inadequate liquid-holding capacity and may have structures that restrict liquid movement through them. Materials with a pore volume over 99.9% have such an open, weak structure that, even with internal reinforcement, durability is too difficult to obtain. The porous support material should also be chemically compatible with and wettable by the liquids of use. The support material must also have sufficient rigidity, strength, and heat resistance that, when reinforced internally, permits operation at temperatures slightly over 200° C. Preferred materials are thermosetting polymer foams of melamine resin, polyimide resin, phenolic resin, or bismaleimide-triazine resin.

A liquid permeation control layer 16 is prepared by adhering a porous material to the surface of the porous support material 14 using a thermosetting adhesive 17 applied to the surface by conventional means, for example, by gravure printing. A suitable porous material for the permeation control layer is porous polytetrafluoroethylene film, preferably porous expanded polytetrafluoroethylene film or, most preferably, porous expanded polytetrafluoroethylene film impregnated with a mixture of silicone oil and silicone rubber as described in Japanese Laid-Open Patent No. 62-178992.

A reinforcing layer 18 is formed internally within the porous support 14 contiguous to the permeation control layer 16 by introducing a mixture of silicone oil and silicone rubber into the end of the porous support 14 and spinning the support about its axis, thus using centrifugal force to direct the mixture outwardly within the porous support to form a layer of uniform thickness contiguous with the inside surface of the permeation control layer 16, after which it is immobilized by crosslinking the silicone rubber.

An oil supply layer 21 is then formed internally within the porous support 14 by introducing a second mixture of silicone oil and silicone rubber into the end of the porous support 14 and spinning the support about its axis, thus using centrifugal force to direct the mixture outwardly within the support to form a layer contiguous with the reinforcing layer 18 and leaving a small section 30 of the porous support 14 unfilled with the mixture. Gelation of the mixture forming the oil supply layer is then effected by crosslinking the silicone rubber.

A key element leading to the invention was the discovery that significant strength can be developed in crosslinked mixtures of silicone oil and silicone rubber without excessive loss of oil holding capacity or oil transfer properties. This discovery permits the use of the thermosetting resins in the open-cell, highly porous forms described above. The thermosetting resins, although having desirable strength, rigidity, chemical and heat resistance properties would, in the open-cell highly porous forms needed for oil-holding capacity and oil delivery, be too weak for use without reinforcement.

The proportions of silicone oil and silicone rubber in the mixtures of the different layers will vary according to the amount of permeation required and to the structures and support materials with which they are used. Silicone oil to silicone rubber ratios may range from 50:1 to 1:20 and will be in the relationship:

$$a/x << b/x <= c/x$$

where a, b, and c are the oil concentrations in the permeation control layer, reinforcing layer, and oil-supply layer respectively.

Discrete reinforcing layers in the porous support are required when the silicone oil to silicone rubber ratio is high, for example, 20:1. At such a concentration oil mobility is high but virtually no strengthening or toughening of the porous support is obtained and a separate reinforcing layer must be provided. As the silicone oil to silicone rubber ratio of the oil-supply layer becomes lower, the reinforcing effects of the crosslinked mixtures increase until, at a silicone oil to silicone rubber ratio of about 9:1, sufficient reinforcement to the porous support is obtained that a separate discrete reinforcing layer is unnecessary. In other words, at silicone oil to silicone rubber mixture ratios of about 9:1, it is possible to combine reinforcing and oil-supply functions in one layer.

Figure 2:
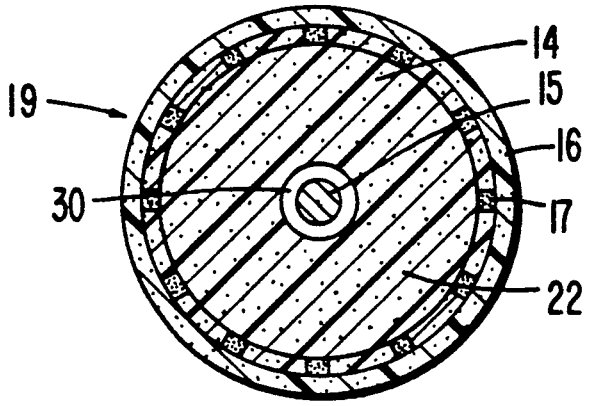
FIG. 2 shows a cross-section of another embodiment of the invention.

An embodiment of the invention combining reinforcing and oil-supply functions in a combination reinforcing/oil-supply layer 22, and not having a discrete reinforcing layer, but otherwise as described hereinabove, is shown in FIG. 2.

Figure 3A:
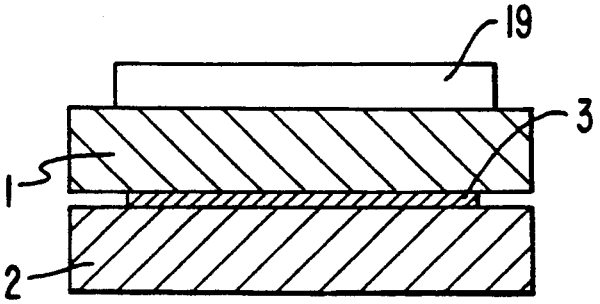
FIGS. 3 and 3*b* show front and side schematic views of a toner fixation mechanism of a PPC copying machine incorporating an embodiment of the invention.
Figure 3B:
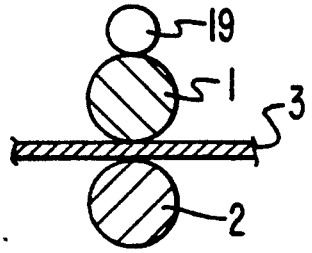

In FIG. 3 the liquid metering and coating device 19 of the invention is shown schematically as part of a toner image fixation mechanism of a PPC copying machine. The liquid metering and coating device 19 is shown in contact with the thermal fixation roll 1 against which a recording medium 3 carrying an unstabilized toner image is being forced by the pressure roll 2.

The following examples further illustrate embodiments of the invention.

EXAMPLE 1

A liquid metering and coating device 19 as shown in FIG. 1 was prepared as follows:

An 8 mm diameter steel shaft 15 was inserted axially into a tubular porous support body 14 of melamine resin. The porous melamine resin body had an outer diameter of 27 mm, an inner diameter of 8 mm, and bulk density of 11 Kg/cubic meter. Thermosetting adhesive dots 17 having 0.5 mm diameters were gravure printed on the porous support body 14 after which formation of the permeation control layer 16 was begun by wrapping a single layer of sintered porous expanded polytetrafluoroethylene film around the porous support body 14 and thermally fusing it in place with the thermosetting adhesive 17. The sintered porous expanded polytetrafluoroethylene film had a pore volume of 80%, a maximum pore size of 0.4 micrometers, and a thickness of 30 micrometers.

A mixture of two parts silicone oil (KF-96, manufactured by Shin-Etsu Chemical Co., Ltd, and used as a releasing agent) and eight parts silicone rubber (KE-106, manufactured by Shin-Etsu Chemical Co., Ltd.) was prepared. The porous expanded polytetrafluoroethylene film was impregnated with the silicone oil/silicone rubber mixture after which the excess mixture was removed from the film surface and the assembly heated at 150° C. for 40 minutes, thus completing formation of the permeation control layer.

A second mixture of the silicone oil and silicone rubber described above, in the ratio seven parts silicone oil to three parts silicone rubber, was poured into the end of the porous support body 14 and, by spinning the assembly about its axis, was directed outwardly through the porous support body to form a reinforcing layer 18 contiguous with the permeation control layer 16. Formation of the reinforcing layer 18 was completed by heating the assembly at 150° C. for 80 minutes to crosslink the silicone rubber.

A third mixture of the silicone oil and silicone rubber described above, in the ratio nine parts silicone oil to one part silicone rubber, was poured into the end of the porous support body 14 and, by spinning the assembly about its axis, was directed outwardly through the porous support body to form an oil-supply layer 21 contiguous with the reinforcing layer 18 and leaving a small section 30 of the porous support body 14 unfilled by the mixture. The assembly was then heated at 150° C. for 80 minutes to crosslink the silicone rubber and cause gelation in the oil-supply layer 21.

The liquid metering and coating device was tested in a plain paper copying machine. Initially, the device applied oil at the rate of 0.1 microliter/A4 size copy. Oil application amounts of 0.1 to 0.2 microliters/A4 size copy were determined from sequential measurements of increments of 20,000 copies until 1,000,000 copies were made. No change in the appearance or shape of the device occurred.

EXAMPLE 2

A liquid metering and coating device 19 having a combination reinforcing/oil-supply layer 22 of nine parts silicone oil to one part silicone rubber, and not having a discrete reinforcing layer, as shown in FIG. 2 was formed from the same materials and by the methods described in Example 1 above.

The liquid metering and coating device was tested in a plain paper copying machine. Initially, the device applied oil at the rate of 0.1 microliter/A4 size copy. Oil application amounts of 0/1 to 0.2 microliters/A4 size copy were determined from sequential measurements of increments of 20,000 copies until 500,000 copies were made. No change in the appearance or shape of the device occurred.

EXAMPLE 3

A liquid metering and coating device 19 having a permeation control layer 16 of sintered porous expanded polytetrafluoroethylene film only, but otherwise as described in Example 2 above, was formed.

The liquid metering and coating device was tested in a plain paper copying machine.

Initially, the device applied oil at the rate of 0.2 microliters/A4 size copy. Oil application amounts of 0.2 to 0.3 microliters/A4 size copy were determined from sequential measurements of increments of 20,000 copies until 500,000 copies were made. No change in the appearance or shape of the device occurred.

We claim:

1. A liquid metering and coating device comprising a) a porous permeation control material of porous polytetrafluoroethylene adhered to the outer surface of b) a porous tubular support comprising an open celled thermosetting polymer;

c) a reinforcing material contiguous with said permeation control material and located in the outer portion of the pores of said porous tubular support, comprising a mixture of silicone oil and silicone rubber;

d) an oil-supply material contiguous with the reinforcing material and substantially filling the pores radially closer to the center of said porous tubular support, comprising a mixture of silicone oil and silicone rubber;

said oil-supply material having a silicone oil to silicone rubber ratio greater than the silicone oil to silicone rubber ratio of said reinforcing material;

silicone oil from said oil-supply material penetrating into said reinforcing material and into said permeation control material.

2. The liquid metering and coating device as recited in claim 1 wherein the pores of the permeation control material contain a mixture of silicone oil and silicone rubber in a silicone oil to silicone rubber ratio less than the silicone oil to silicone rubber ratio of the reinforcing material.

3. The liquid metering and coating device as recited in claim 1 or claim 2, wherein the porous permeation control material is porous expanded polytetrafluoroethylene.

4. A liquid metering and coating device as recited in claim 3 wherein the reinforcing material and the oil-supply material are combined and formed from a mixture of silicone oil and silicone rubber having a silicone oil to silicone rubber ratio greater than the silicone oil to silicone rubber ratio of the permeation control material.

* * * * *